United States Patent [19]

Pliml, Jr.

[11] Patent Number: 4,532,387

[45] Date of Patent: Jul. 30, 1985

[54] TWO-POSITION ROTARY SWITCH ASSEMBLY

[75] Inventor: Frank V. Pliml, Jr., Arlington Heights, Ill.

[73] Assignee: Illinois Tool Works Inc., Chicago, Ill.

[21] Appl. No.: 576,600

[22] Filed: Feb. 3, 1984

[51] Int. Cl.[3] ..... H01H 19/36

[52] U.S. Cl. ..... 200/11 R; 200/155 R

[58] Field of Search ..... 200/11, 155 R, 291, 200/293-296, 336

[56] References Cited

U.S. PATENT DOCUMENTS

| | | | |
|---|---|---|---|
| 2,620,409 | 12/1952 | Cobb et al. | 200/11 EA |
| 3,040,151 | 6/1962 | Reihman et al. | 200/11 EA |
| 3,167,620 | 1/1965 | Keyser et al. | 200/11 R |
| 3,244,820 | 4/1966 | Cannon | 200/11 E |

*Primary Examiner*—J. R. Scott

*Attorney, Agent, or Firm*—J. P. O'Brien; T. W. Buckman

[57] ABSTRACT

A two-position rotary switch assembly is constructed of a mounting member and a switching member. The mounting member has an electrically non-conducting body in the form of a head portion with a central opening and a shank portion with a throughbore in axial alignment with the central opening. The switching member includes an electrically non-conducting rotary part having a shaft portion rotatably disposed in the throughbore of the mounting member and a knob portion which includes a flange integrally formed in normal relation to the shaft portion and slidingly engaging the head portion of the mounting member. Stop means is provided for limiting the rotational motion of the switching member between two arcuate positions. An electrical contact member is mounted on the shaft portion and includes an arm portion that is disposed along a chordal flat formed inwardly of the circumferential surface of the shaft portion. A longitudinal slot formed in the shank portion of the mounting member is orientated relative to the shaft portion such that the slot is in direct alignment with the recess upon the switching member being moved to one of the two switching positions.

12 Claims, 7 Drawing Figures

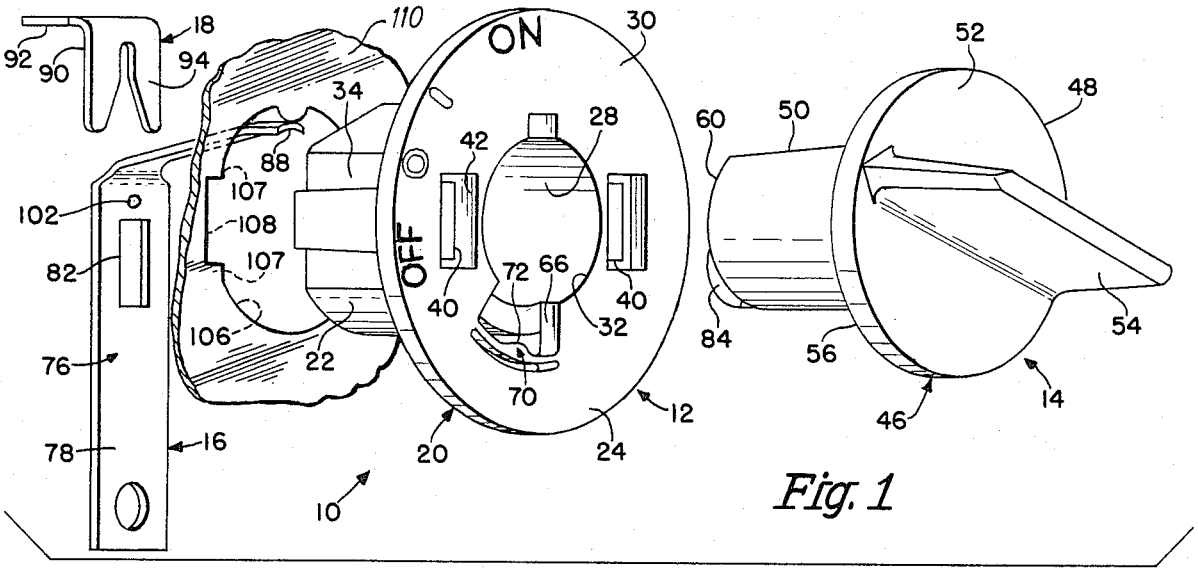
Fig. 1
Fig. 2
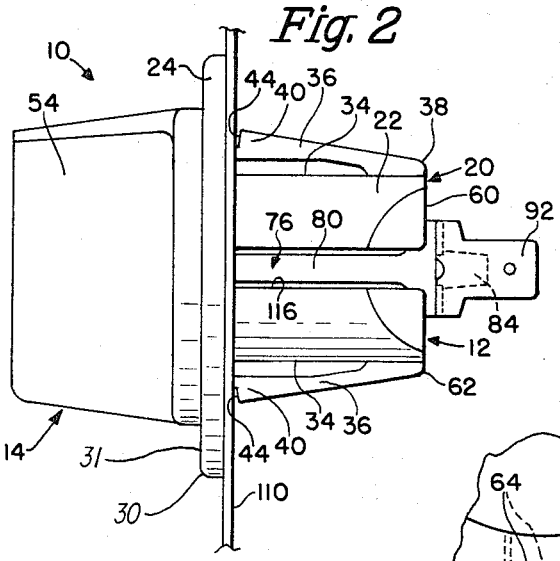
Fig. 3
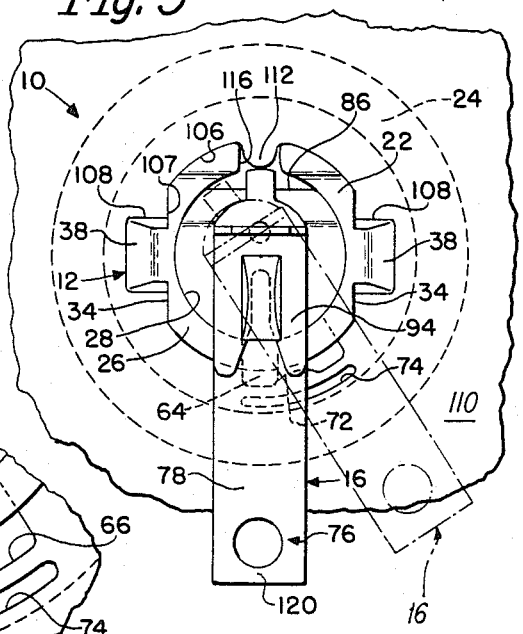
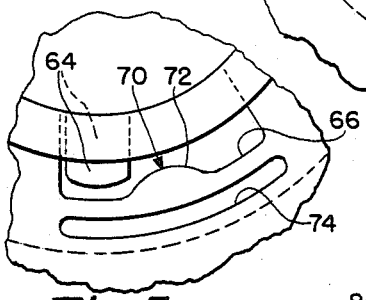
Fig. 5
Fig. 4
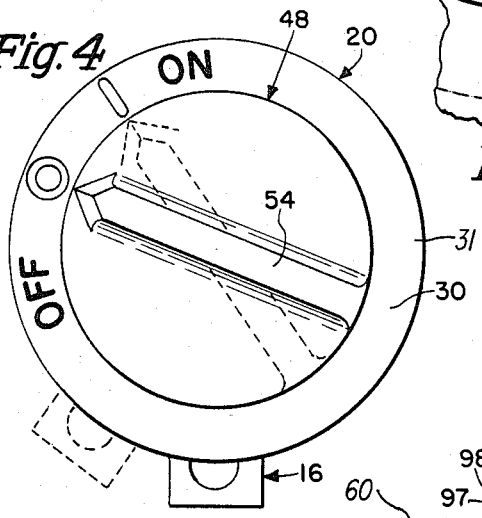
Fig. 6
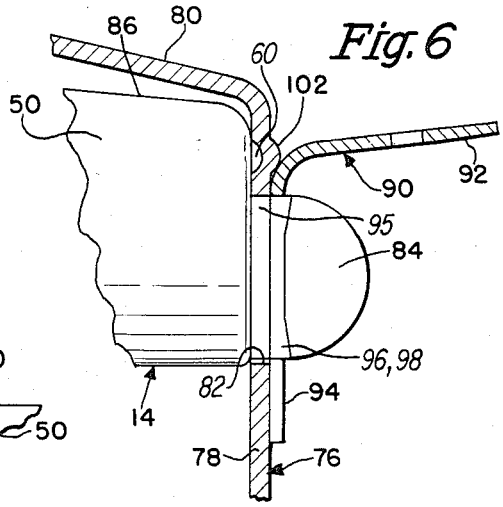
Fig. 7
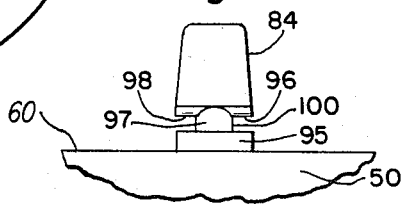

TWO-POSITION ROTARY SWITCH ASSEMBLY

BACKGROUND OF THE INVENTION

This invention is related to a rotary switch assembly having two positions, and in particular relates to a two-position rotary switch assembly which is readily mounted in an apertured panel.

This invention is designed to provide a two-position rotary switch which is quick and easy to assemble and which can be readily mounted in an apertured panel.

A further object of this invention is to provide a two-position rotary switch which has a combined capability of serving as an electrical switch and as an engine choke-off device for internal combustion engines.

A further object of this invention is to provide a two-position switch having four parts which can be assembled together quickly to provide an inexpensive, high-quality switch.

SUMMARY OF THE INVENTION

This invention is directed to a two-position rotary switch assembly constructed of a mounting member having resilient leg means to mount the switch assembly in an apertured panel and a switching member having a non-conducting rotary part which can be rotated between two switch positions. The non-conducting rotary part has a knob portion and a shaft portion which is rotatably disposed in the throughbore of the mounting member. An electrical contact means is mounted on the shaft portion and includes at least one arm portion that is disposed along the peripheral surface of the shaft portion. An elongate slot is formed in the shank portion of the mounting member to provide access for making contact with the electrical contact arm portion upon the switching member being moved to one of the two switch positions.

BRIEF DESCRIPTION OF DRAWING

For a better understanding of this invention, reference may be made to the accompanying drawing, in which:

FIG. 1 is an exploded view of the four parts which when assembled together comprise the preferred embodiment of this invention;

FIG. 2 is a side elevational view of a two-position rotary switch assembly embodying the principles of this invention;

FIG. 3 is a bottom plan view of the preferred embodiment of this invention when assembled into an apertured panel and showing the position of parts when the switch is turned to the "off" position;

FIG. 4 is a top plan view of the preferred embodiment of this invention showing the position of parts in solid lines when the switch is in an "off" position and in dotted lines when the switch is connected in the "on" position;

FIG. 5 is a partial view of the bottom plan view of FIG. 3 illustrating the catch means for holding the switching member in one switching position;

FIG. 6 is a section view of the bottom end of the switch assembly depicting the mounting arrangement of the actuator means and clamping means; and FIG. 7 is a partial bottom elevational view of the switching member showing the mounting post.

DESCRIPTION OF PREFERRED EMBODIMENT

Referring to the drawing, there is shown a two-position rotary switch assembly generally designated by the reference numeral 10. Switch assembly 10 is assembled from four interfitting and cooperating components: mounting member 12, switching member 14, actuator means 16 and clamping means 18.

Mounting member 12 has an electrically non-conducting body 20 which is formed with a shank portion 22 and a head portion 24. The shank portion 22 has a generally cylindrical shaped body 26 which is formed with a large diameter throughbore 28.

The head portion 24 of mounting member 12 is constructed of a circular disc 30 which is integrally formed with the cylindrical shaped body 26 of shank portion 22. Circular disc 30 has a central opening 32 in direct alignment with throughbore 28.

Two flat chordal segments are formed on cylindrical body 26 at diametrically opposite positions to define a pair of parallel surfaces 34. Extending lengthwise on these parallel surfaces 34 are a pair of resilient leg members 36.

As best illustrated in FIG. 2, the leg members 36 have their base integrally formed at the outer free end of shank portion 22. The resilient legs 36 diverge outwardly from the base 38 in a general direction towards head portion 24. When flexed inwardly to the mounted position as depicted in FIG. 2, the outer free ends 38 of resilient legs 36 extend a short distance into the rectangular apertures 42 (FIG. 1) formed in the circular disc 30. A shoulder portion 44 is formed on each free end 38 to securely hold the mounting member 12 in an apertured panel as will be described hereinafter.

The switching member 14 is constructed as a one-piece molded part 46 formed of an electrically non-conducting material in the form of a knob portion 48 and cylindrical-shaped shaft portion 50.

The shaft portion 50 has an external diameter slightly smaller than the diameter of throughbore 28. The knob portion 46 has a circular flange 52 integrally connected in a normal relation to the shaft portion 50 and a finger gripping portion 54 which extends diagonally across the circular flange 52.

The shaft portion 50 is inserted into the throughbore 28 until the undersurface 56 of circular flange 52 abuts against the outer surface 31 of circular disc 30. In this position, shaft 50 has its free end 60 substantially flush with the outer end 62 of shank portion 22, as illustrated in FIG. 2.

As is illustrated in FIG. 5, there is a finger member 64 which extends downwardly from the undersurface area 56 of circular flange 52 in a radial outward direction from the shaft portion 50. When the switching member 14 is inserted into the mounting member 12, the finger member 64 is adapted to ride in arcuate slot 66 which is formed through circular disc 30 radially from the central opening 32. A catch means 70 is carried on the circular disc 30 to hold the finger member 64 in either a first or second switching position. Catch means 70 comprises detent 72 which is formed midway of the arcuate slot 66. Detent 72 has an outer curved portion which is struck by the outer end of the finger member 64 as the switching member is moved between the first and second switching positions. To enable the detent 72 to flex radially outward in response to contact by the finger member 64, an elongate slot 74 is formed radially outward of slot 66 and has an arcuate length greater than the length of the arcuate slot 66.

From the foregoing description it will be appreciated that the length of arcuate slot 66 determines the rotational movement of the switching member 14 relative to the mounting member 12. This rotational movement is depicted in FIG. 4. Knob portion 48 can be manually set in either the "off" position represented by the solid line of the "on" position represented by the dotted line. The preferred embodiment is shown for exemplury purposes as a safety switch for an internal combustion engine. For this particular application, the switch 10 is moved to the "off" position to electrically connect the ignition coil of the internal combustion engine to a grounded plate, as will be explained in complete detail hereinafter. When switch 10 is moved to the "on" position, it disconnects the circuit between the ignition coil of the internal combustion engine and the grounded plate. Thus the "on" position allows the user to start and operate the internal combustion engine. Whereas, the "off" position indicates to the user that the internal combustion engine cannot be operated because its ignition coil is connected to a grounded plate.

Actuator means 16 comprises a one-piece electrical conducting element 76 which is bent into first and second arm portions 78 and 80, respectively. Arm portion 78 has a rectangular aperture 82 which fits over a mounting post 84 that is integrally formed and extending axially of the free end 60 of shaft portion 50.

The other arm portion 80 is bent at an angle to correspond to the angle of chordal flat 86 which extends from the free end 60 of shaft portion 50 to the circular flange 52. When assembled the arm portion 80 extends the entire length of chordal flat 86 and terminates at its free end 88 a slight distance from undersurface 56 of circular flange 52.

Clamping means 18 is formed of an electrically conducting material in the shape of a right-angle element 90 having a flat terminal portion 92 and a C-shaped clamping portion 94. A mounting post 84 (FIGS. 6 and 7) is formed at its base with a rectangular section 95 having dimensions slightly smaller than the dimensions of aperture 82 and with a reduced thickness section 97 to define a stem portion 100 having a pair of parallel shoulders 96 and 98. The thickness of the C-shaped element 94 is slightly less than the thickness of the stem portion 100.

From the foregoing description it will be appreciated that the switch assembly 10 is quickly constructed from the four parts shown in the exploded view of FIG. 1. The shaft portion 50 of switching member 14 is inserted into the throughbore 28 of mounting member 12 until the undersurface 56 of circular flange 52 contacts the outer surface 31 of circular disc 30 for the head portion 24. In this position the circular end base 60 of shaft portion 50 is substantially flush with the annular end 62 of cylindrical shaped body 26.

The rectangular slot 82 of the arm portion 78 is then installed over the rectangular section 95 at the base of the mounting post 84 such that the arm portion 80 is disposed along the chordal flat 86. The C-shaped clamp 94 is then wedged between the arm portion 78 and the pair of shoulders 96 and 98 and slid forward until the C-shaped clamp 94 passes over the dimpled detent 102. This clamping arrangement provides a very strong and effective means of clamping the four major parts together in the manner shown in FIG. 2.

The switch assembly 10 is readily installed in a panel 110 having an aperture 106 of the shape illustrated in FIG. 1 by simply inserting the shank portion 22 into the aperture 106. The pair of resilient leg members 36 will yield inwardly as the switch assembly is inserted through the apertured panel until the resilient leg members pass the thickness of the panel, at which point the outer free ends 40 spring outwardly. The shoulders 44 fit into the diametrically opposing cut-out ear portions 108 of aperture 106 (FIG. 1) as illustrated in FIG. 3.

When mounted in an apertured panel 110, mounting member 12 is held against rotation by virtue of the relationship between the flat parallel chordal segments 34 on cylindrical body 26 and the chordal segments 107 formed in the circular aperture 106 at its juncture with cut-out ear portions 108.

In the drawing, the switch assembly 10 is illustrated as being installed in aperture 106 which is formed in a metal panel 110. A boss 112 is formed radially inwardly of aperture 106.

Boss 112 is located midway between the ear portions 108 and in direct alignment with an axially oriented slot 116 which extends the length of shank portion 22. The width of slot 116 is made to receive boss 112, as depicted in FIG. 3.

The location of slot 116 is selected to cause electrical contact arm portion 80 of electrical conducting element 76 to be in direct alignment with slot 116 upon knob portion 48 being rotated to the "off" position. Obviously, the slot 116 could be relocated to be in direct alignment with contact arm portion 80 in the "on" position, as dictated by the particular application of switch assembly 10.

One application that switch assembly 10 has been effectively used is as a shut-off control for an internal combustion engine. In this application, metal panel 110 represents the cover plate for the engine and thus functions as an electrical ground potential. Terminal portion 92 of clamping means 18 would be electrically connected to the ignition coil wire of the internal combustion engine. Thus, the movement of knob portion 48 to "off" causes the ignition coil wire to be grounded through the electrical path connected from boss 112 of metal panel 110, through contact arm portion 80 and terminal portion 92.

When switch assembly 10 is used as a shut-off control for an internal combustion engine, a second engine shut-off means can be provided by interconnecting the outer end 120 of arm portion 78 to the butterfly valve (not shown) on the internal combustion engine's carburetor by means of a well-known linkage device. With this arrangement, rotation of knob portion 48 to "off" causes the butterfly valve to rotate to choke off the carburetor.

One significant design feature of this invention is provided by locating the terminal portion 92 close to the pivot center of switching member 14. This location causes the wire connectd to terminal portion 92 to move through a short arc as the switching member 14 is rotated between its two switching positions. The benefit of this location is that it avoids destructive twisting of the electrical connector which is mounted on terminal 92.

It will be appreciated that the switch assembly 10 could be used for a wide variety of applications and that its use as an engine shut-off control for an internal combustion engine is given for illustration purposes only.

I claim:

1. A two-position rotary switch assembly comprising a mounting member and switching member, said mounting member including an electrically non-conducting body having a head portion with a central opening and a shank portion with a throughbore in axial alignment with said central opening, said switching member including an electrically non-conducting rotary part having a knob portion and a generally cylindrical-shaped shaft portion of a diameter slightly smaller than the diameter of said throughbore, said knob portion including a flange integrally formed in normal relation to said shaft portion and having its undersurface slidingly engage said head portion of said mounting member, stop means for limiting the rotational motion of said switching member relative to said mounting member between first and second positions, catch means for releasably holding said switching member in one of said first and second positions, and an electrical contact means mounted on said shaft portion and includes at least one arm portion, a recess extending from the free end of said shaft portion inwardly of its peripheral surface, said at least one arm portion disposed in said recess, and a slot formed through said shank portion at a location which is in direct alignment with said recess of said shaft portion upon said switching member being moved to one of said first and said second positions.

2. A two-position rotary switch assembly as defined in claim 1, wherein said mounting member further comprises a pair of resilient legs diverging away from said shank portion toward said head portion and terminating a short distance from said head portion for mounting said switch assembly in an apertured panel and means for preventing the rotation of said mounting member relative to an apertured panel.

3. A two-position rotary switch assembly as defined in claim 1, further comprising a mounting post extending from said free end of said shaft portion and radially disposed relative to the axis of said shaft portion, said mounting post having a reduced thickness portion adjacent said free end to form a pair of parallel shoulders, said electrical contact means having a second arm portion with an aperture larger than the cross sectional dimensions of said mounting post formed at its inner end and disposed over said mounting post and having its outer end extend beyond said shank portion of said mounting member, and a C-shaped locking member frictionally mounted between said pair of parallel shoulders and said other arm portion of said electrical contact to hold the parts together in assembled relationship.

4. A two-position rotary switch assembly as defined in claim 3, wherein said C-shaped locking member is formed of an electrically conducting material and includes a second angled segment extending generally axially in a close spatial relationship to the axis of said shaft portion.

5. A two-position rotary switch assembly as defined in claim 1, wherein said stop means for limiting the rotational motion of said switching member comprises an arcuate slot formed in said head portion of said mounting member and a finger member formed on the undersurface of said flange of said knob portion and disposed into said arcuate slot.

6. A two-position rotary switch assembly as defined in claim 5, wherein said catch means comprises a detent formed at the center of said arcuate slot between said first and second switch positions and projecting in the path of said finger member and an arcuate relief segment formed radially outwardly of said arcuate slot to allow said detent to be free to flex radially.

7. A two-position rotary switch assembly comprising a mounting member and switching member, said mounting member including an electrically non-conducting body having a head portion with a central opening and a shank portion with a throughbore in axial alignment with said central opening, said switching member including an electrically non-conducting rotary part having a knob portion and a generally cylindrical-shaped shaft portion of a diameter slightly smaller than the diameter of said throughbore, said knob portion including a flange integrally formed in normal relation to said shaft portion and having its undersurface slidingly engage said head portion of said mounting member, stop means for limiting the rotational motion of said switching member relative to said mounting member between first and second positions, detent means for releasably holding said switching member in one of said first and second positions, and an electrical contact member mounted on said shaft portion and having two arm portions, a recess formed inwardly of its peripheral surface and extending axially the entire length of said shaft portion, one of said arm portion disposed in said recess and extending to said head portion and the other of said arm portions extending from the free end of said shaft portion, and a slot formed through said shank portion at a location which is in direct alignment with said recess of said shaft portion upon said switching member being moved to one of said first and second positions.

8. A two-position rotary switch assembly as defined in claim 7, wherein said mounting member further comprises a pair of resilient legs diverging away from said shank portion toward said head portion and terminating a short distance from said head portion for mounting said switch assembly in an apertured panel.

9. A two-position rotary switch assembly as defined in claim 7, further comprising a mounting post extending from said free end of said shaft portion and radially disposed relative to the axis of said shaft portion, said mounting post having a reduced thickness portion adjacent said free end to form a pair of parallel shoulders, said other arm portion of said electrical contact having an aperture larger than the cross sectional dimensions of said mounting post formed at its inner end and disposed over said mounting post and having its outer end extend beyond said shank portion of said mounting member, and a C-shaped locking member frictionally mounted between said pair of parallel shoulders and said other arm portion of said electrical contact to hold the parts together in assembled relationship.

10. A two-position rotary switch assembly as defined in claim 9, wherein said C-shaped locking member is formed of an electrically conducting material and includes a second angled segment extending generally axially in a close spatial relationship to the axis of said shaft portion.

11. A two-position rotary switch assembly as defined in claim 7, wherein said stop means for limiting the rotational motion of said switching member comprises an arcuate slot formed in said head portion of said mounting member and a finger member formed on the undersurface of said flange of said knob portion and disposed into said arcute slot.

12. A two-position rotary switch assembly as defined in claim 11, wherein said catch means comprises a detent formed at the center of said arcuate slot between said first and second switch positions and projecting in the path of said finger member and an arcuate relief segment formed radially outwardly of said arcuate slot to allow said detent to be free to flex radially.

* * * * *